United States Patent [19]

Dobashi et al.

[11] Patent Number: 4,887,002

[45] Date of Patent: Dec. 12, 1989

[54] GAS DISCHARGE LAMP AND APPARATUS UTILIZING THE SAME

[75] Inventors: Yoshitomi Dobashi, Fujisawa; Akihiro Inoue, Chigasaki, both of Japan

[73] Assignee: Kabushiki Kaisha Toshiba, Kawasaki, Japan

[21] Appl. No.: 127,486

[22] Filed: Dec. 1, 1987

[30] Foreign Application Priority Data

Dec. 1, 1986 [JP] Japan ..... 61-286410

[51] Int. Cl.[4] ..... H01J 61/78

[52] U.S. Cl. ..... 313/607; 313/594; 313/573

[58] Field of Search ..... 313/576, 572, 573, 581, 313/594, 601, 607; 315/70, 239

[56] References Cited

U.S. PATENT DOCUMENTS 4,645,979 2/1987 Chow ..... 315/169.1

FOREIGN PATENT DOCUMENTS 57-38571 3/1982 Japan .
58-34560 3/1983 Japan .
61-63760 4/1986 Japan .
61-95052 6/1986 Japan .
2067826 7/1981 United Kingdom .

OTHER PUBLICATIONS

Toshiba Review 1985, vol. 40, No. 12, pp. 1079 to 1082 "fluorescent Xenon Glow Lamp" Yoshiji Yoshiike.

*Primary Examiner*—Robert L. Griffin
*Assistant Examiner*—T. Salindong
*Attorney, Agent, or Firm*—Cushman, Darby & Cushman

[57] ABSTRACT

A gas discharge lamp has a discharge gas sealed in a light-transmissive, cylindrical tube in which an internal electrode is provided as a first receiving end. An external electrode having predetermined widths along the axis of the tube is provided on the outer surface of the tube as a second receiving end. A shielding film is also provided on the outer surface of the tube excluding where a slit with a predetermined width is formed. The widths of the external electrode can be changed in accordance with the luminance distribution of the gas discharge lamp. The internal and external electrodes are connected to a high frequency power source and are applied with high frequency power therefrom, thereby causing discharge within the tube.

10 Claims, 4 Drawing Sheets

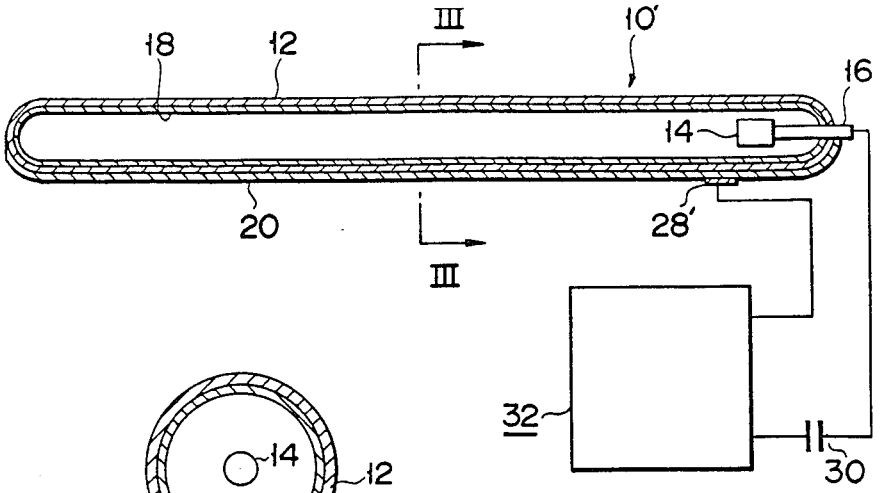
FIG. 7
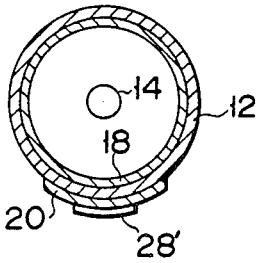
FIG. 8
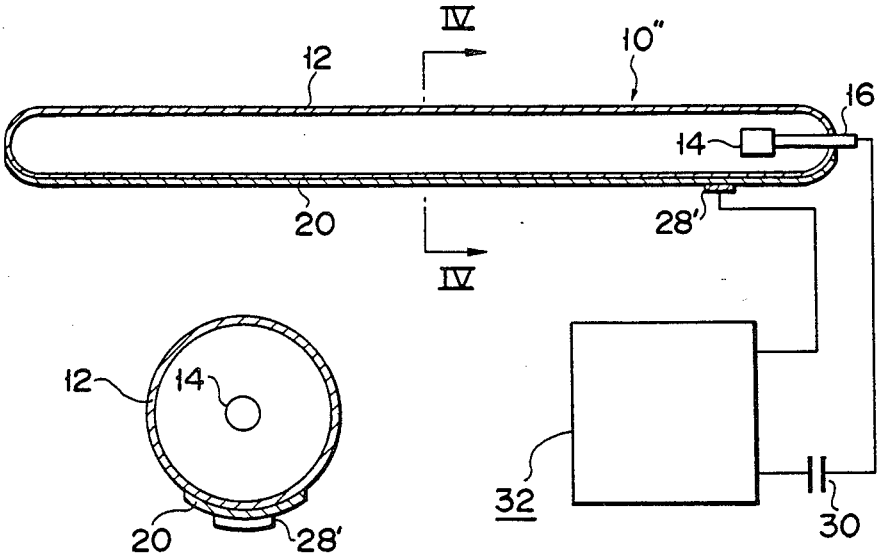
FIG. 9
FIG. 10

GAS DISCHARGE LAMP AND APPARATUS UTILIZING THE SAME

U.S. application Ser. No. 07/055,610 filed May 29, 1987, U.S. application Ser. No. 07/073,824 filed Mar. 25, 1988, and U.S. application Ser. No. 07/173,117 filed May 25, 1988 related to the present application.

BACKGROUND OF THE INVENTION

This invention relates generally to a gas discharge lamp and, more particularly, to an improvement of a gas discharge lamp which causes glow discharge by applying high frequency power between an internal electrode provided within a tube and an external electrode formed in a belt shape on the outer surface of the tube along the axis of the tube. Such a gas discharge lamp is disclosed, for instance, in Japanese Patent Disclosure No. 58-34560 (U.S. Pat. No. 4,645,979) which has one of the electrode pair provided within the tube as an internal electrode and has the other one of the electrode pair intimately provided on the outer surface of the tube as an external electrode. The internal and external electrodes are applied with high frequency power from an external power source so as to cause glow discharge within the tube.

The external electrode of the discharge lamp is a belt shaped electroconductive film or the like, which has uniform width along the axis of the tube. However, a uniform luminance distribution of the discharge lamp mentioned above along the axial direction of the tube is not obtained, which fact is found by no other than the present inventors for the first time. Although the reason for this non-uniform luminance distribution has not been clarified, the following can be deduced.

While the discharge lamp is being turned on, glow discharge occurs between the external and internal electrodes. The external electrode is formed in a belt shape along the axis of the tube, while the internal electrode is sealed in the tube and is positioned at one end thereof. Thus, the distance between both electrodes becomes larger towards the other end of the tube. Accordingly, the farther a position of the external electrode is from the internal electrode, the gentler the electric field strength becomes, which leads to a decreased density of ions and electrons, both obtained by electric dissociation. Accordingly, the larger the distance between these two electrodes becomes, the lower the current density becomes, which leads to lowering the ratio of the excitation of the fluorescent material. Thus, the end portion of the tube that is far away from the internal electrode will be low in luminous intensity compared with the central portion of the tube. A similar phenomenon will occur to a gas discharge lamp in which no fluorescent material is used.

At the proximity of the internal electrode or the region where the distance between both electrodes is small, the current density is higher than at the center portion of the tube. Since, however, a sufficiently large space can hardly be obtained at the proximity of the internal electrode, the electrons and ions will not be sufficiently accelerated. As a result, the excitation power of the fluorescent material will be small. Thus, the end portion of the tube that is near the internal electrode will be low in luminous intensity compared with the central portion of the tube.

Consequently, it may safely be said that the current density distribution greatly influences the luminance distribution.

SUMMARY OF THE INVENTION

It is accordingly an object of this invention to provide a gas discharge lamp, which ensures that the luminance in the axial direction of the tube can be set to have a desired distribution. For instance, it is possible to provide a luminance distribution nearly uniform along the axis of the tube.

To achieve this object, a gas discharge lamp according to one embodiment of this invention comprises: a tube having a discharge gas therein; an internal electrode provided within the tube; and an external electrode provided on an outer surface of the tube generally parallel to an axis of the tube, the external electrode having a width that is non-uniform along the axis, the width at various positions along the axis being selected so as to obtain a desired luminance distribution, the internal and external electrodes being adapted to be coupled to a high frequency power source to cause discharge within the tube.

The object can also be achieved by a gas discharge lamp apparatus according to another embodiment of this invention, which comprises: a gas discharge lamp device including a tube having a discharge gas therein, an internal electrode provided within the tube, and an external electrode provided on an outer surface of the tube generally parallel to an axis of the tube, the external electrode having a width that is non-uniform along the axis, the width at various positions along the axis being selected so as to obtain a desired luminance distribution; and a high frequency power source for applying high frequency power to the internal and external electrodes of the gas discharge lamp device to cause discharge within the tube and irradiating visible rays generated by the discharge to the outside of the tube.

BRIEF DESCRIPTION OF THE DRAWINGS

These and other features and advantages of this invention will become more apparent from the following detailed description of exemplary embodiments as illustrated in the accompanying drawings in which:

FIG. 7 is a schematic diagram showing a gas discharge lamp apparatus according to the second embodiment of this invention;

FIG. 8 is a cross-sectional view showing the lamp apparatus of FIG. 7, as taken along line III—III;

FIG. 9 is a schematic diagram showing a gas discharge lamp apparatus according to the third embodiment of this invention; and FIG. 10 is a cross-sectional view showing the lamp apparatus of FIG. 9, as taken along line IV—IV.

DETAILED DESCRIPTION OF THE PREFERRED EMBODIMENTS

Figure 1:
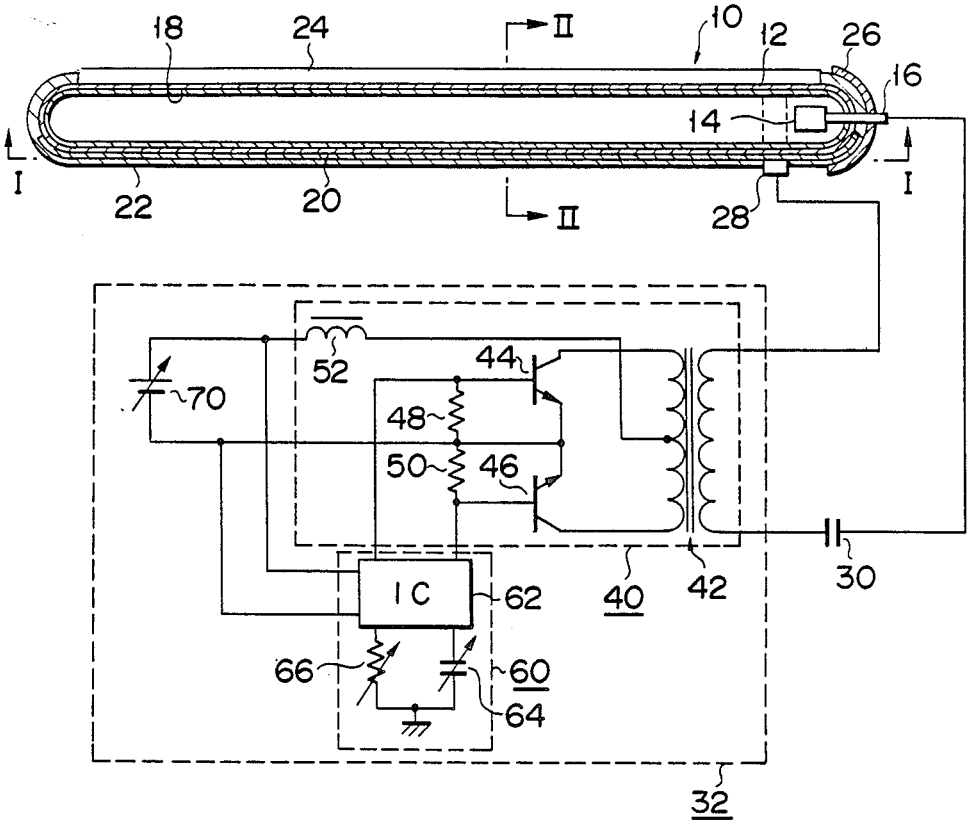
FIG. 1 is a schematic overall view of a gas discharge lamp apparatus according to the first embodiment of this invention.

A gas discharge lamp apparatus according to the first embodiment of this invention will be explained below with reference to FIGS. 1 to 6.

In the diagrams, a discharge lamp 10 includes a tube 12 of a cylindrical configuration with each end closed. Tube 12 is made of a light-transmissive quartz glass or a hard or soft glass, and has, for example, an internal diameter of below 2 mm, or an external diameter of below 3 mm. A rare gas of at least one kind selected from the group including xenon, krypton, argon, neon, helium is sealed into tube 12 with xenon as a principal component. The pressure under which these rare gases are sealed in tube 12 is, for example, 30 to 160 Torr and light output in this case varies in proportion to the rare gas pressure level.

Within tube 12, an internal electrode 14, which is made of, for example, nickel and 1.2 mm in the outer diameter, is provided at one end of the tube and serves as one of a pair of electrodes. An emitter material is coated on the surface of internal electrode 14 to facilitate an electron emission. Internal electrode 14 is sealingly mounted by a "pinch-sealing" method. A lead-in wire 16 which penetrates through the end wall of tube 12 in a gas-tight fashion is connected to internal electrode 14 and is sealed within tube 12.

A fluorescent material film 18 is formed on the inner surface of tube 12 with an even film thickness which is so set as to obtain a transmittance of 25 to 40%, for example.

Figure 2:
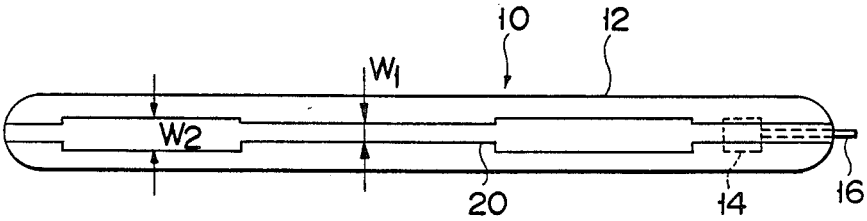
FIG. 2 is a cross-sectional view showing the lamp apparatus of FIG. 1, as taken along line I—I.
Figure 3:
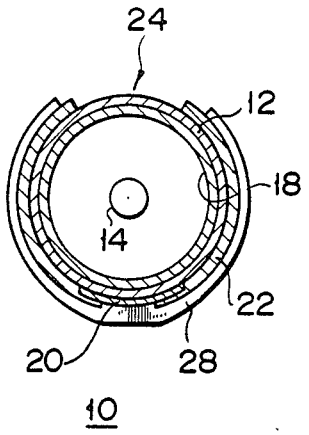
FIG. 3 is a cross-sectional view showing the lamp apparatus of FIG. 1, as taken along line II—II.
Figure 4:
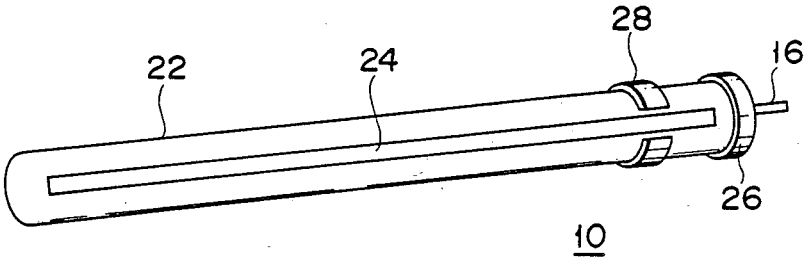
FIG. 4 is an outer, perspective view showing the lamp apparatus of FIG. 1.

An external electrode 20 is intimately attached to the outer side portion of tube 12 and serves as the other electrode. External electrode 20 is made of an electroconductive coating film which is obtained by coating, for example, a copper/carbon blended paste on the surface portion of the tube and sintering it. This external electrode 20 is formed from end to end across the whole length of tube 12. As shown in FIG. 2, for example, attached in close contact with the tube, the external electrode 20 is formed narrower ($W_1$; e.g., 2 mm) at its center portion with each end portion being wider ($W_2$; e.g., 4 mm).

A light shielding film 22 is formed on the outer surface of tube 12 with an opening or a slit 24, formed opposite to external electrode 20 to allow passage of a predetermined quantity of light. More specifically, light shielding film 22 is formed over the whole surface of tube 12 except for slit 24, also covering external electrode 20, with the width of slit 24 formed substantially uniformly across the whole length of the tube.

In tube 12, first receiving end film 26 is formed on the outer surface portion of that tube end portion in which internal electrode 14 is sealed, that is, on the outer surface of light shielding film 22. This first receiving end film 26, which is made of an electroconductive paste, such as silver-epoxy resin, is connected to lead-in wire 16 which is connected to internal electrode 14.

A second receiving end film 28 is formed on the outer surface of tube 12 or the outer surface of light shielding film 22, except on slit 24, in an axially spaced-apart relationship to first receiving end film 26. This second receiving end film 28 is also formed of an electroconductive paste, such as silver-epoxy resin and is circumferentially provided with a predetermined width. Second receiving end film 28 is connected to external electrode 20.

Internal electrode 14 is connected to a high frequency power source 32 through first receiving end film 26 while external electrode 20 is connected to the same power source through second receiving end film 28 and a current-limiting capacitor 30. High frequency power source 32 comprises an inverter circuit 40, a frequency generating section 60 and a power source 70.

Inverter circuit 40 is of such a push-pull type that a transformer 42 has its primary winding connected to the collectors of switching transistors 44 and 46 and its secondary winding connected to discharge lamp 10. Switching transistors 44 and 46 have their emitters connected to each other with their common node coupled to a negative terminal (−) of variable D.C. power source 70. Resistors 48 and 50 are respectively connected between bases and emitters of these switching transistors 44 and 46.

Switching transistors 44 and 46 have their bases connected to I.C. 62 (e.g., TL494, a product of Texas Instruments Inc.) which, together with a variable capacitor 64 and a variable resistor 66, constitutes a frequency generating circuit. Variable capacitor 64 and variable resistor 66 are both grounded.

I.C. 62 is connected to both terminals of D.C. power source 70. D.C. power source 70 has its positive terminal (+) connected to a predetermined location on the primary winding side of transformer 42 through a choke coil 52.

In the thus constituted gas discharge lamp apparatus, high frequency power is supplied from D.C. power source 70 to internal electrode 14 and external electrode 20 through push-pull inverter 40 and through first and second receiving end films 26 and 28. The frequency employed is set to a proper value by frequency generating section 60 that comprises I.C. 62, variable capacitor 64 and variable resistor 66.

When current is supplied to internal electrode 14 and external electrode 20, the direct current is converted into an alternating current with the aforementioned proper frequency through push-pull inverter 40. The converted high frequency current causes a glow discharge corresponding to a lamp current of below 20 mA across internal electrode 14 and external electrode 20 within tube 12. As a result, fluorescent material film 18 is excited by a resonance line of the rare gas within tube 12 to produce visible light. The visible light is emitted as a narrow beam to the outside of tube 12 through slit 24.

As mentioned earlier, when the external electrode has a standard shape and an even width over the whole length, the current density is in general decreased at a location where internal electrode 14 is remote from external electrode 20. On the other hand, at a location where internal electrode 14 is close to external electrode 20, there is not a sufficient space between these internal and external electrodes for electrons from the internal electrode to be adequately accelerated, thus reducing the luminance level there. In this respect, referring to FIGS. 5 and 6, a standard external electrode 202 having an even width throughout its length will now be compared with an external electrode 204 that has different widths according to this invention.

Figure 5:
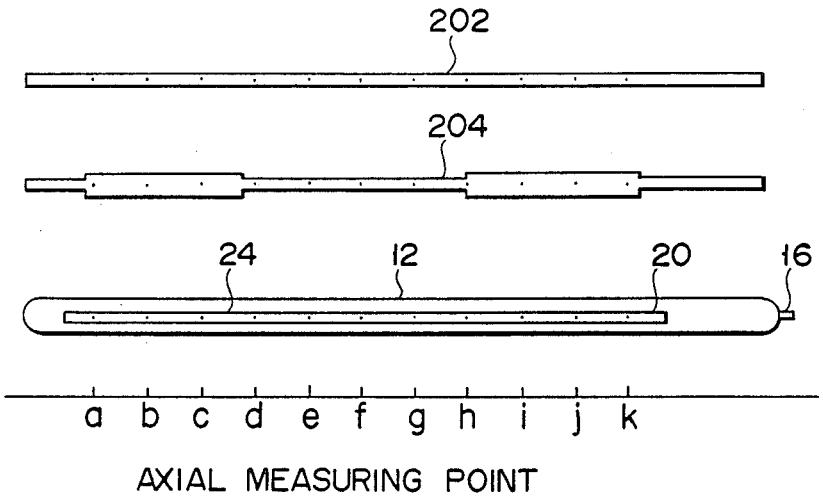
FIG. 5 is a diagram showing luminance-distribution measuring points a to k on a standard external electrode of a gas discharge lamp and an external electrode of a gas discharge lamp according to this invention.
Figure 6:
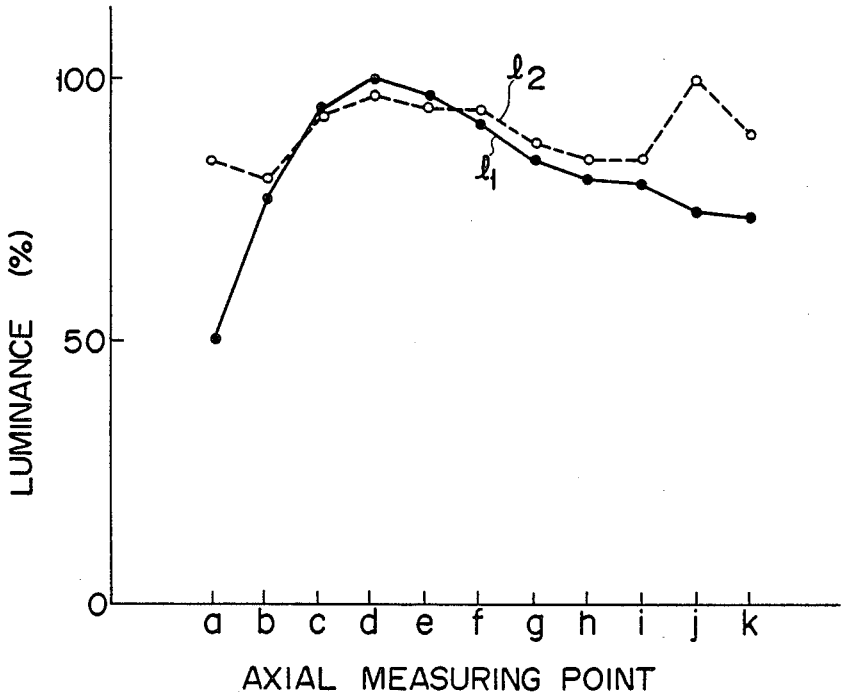
FIG. 6 is a graph showing the luminance distributions for the two cases of FIG. 5 at the individual points a to k.

In FIG. 5, with an aperture type lamp in which tube 12 has an outer diameter of 2.5 mm and a length of 70 mm with xenon gas sealed in the tube under a gas pressure of 50 to 100 Torr, for example, predetermined measuring points a to k are set, as illustrated, on each external electrode. These measuring points a to k correspond to points a to k in the graph of FIG. 6. Here, standard external electrode 202 is assumed to have an even width W of 2 mm over the entire length while external electrode 204 is assumed to have a narrow width $W_1$ (2 mm) at its center portion (points d to g) and each end portion and a wide width $W_2$ (4 mm) between the center portion and both end portions (points a to c and h to k).

When this lamp 10 is lit at a high frequency of 50 KHz, the luminance distributions for external electrodes 202 and 204 are respectively represented by the solid line $l_1$ and the dotted line $l_2$. For each case, the maximum level is considered to be 100% luminance. That is, external electrode 202 has a 100% luminance at point d while the other external electrode 204 has it at point j. In these measuring conditions, the luminance of external electrode 202 ranges approximately from 50 to 100%. For the case of external electrode 204, by way of contrast, the luminance ranges approximately from 85 to 100%.

During energization of the lamp, discharge occurs across external electrode 20 and internal electrode 14. External electrode 20 is made wider ($W_2$) at a portion (points a to c) where the electrode 20 is remote from internal electrode 14. As a consequence, the current density at points a to c becomes high and the excitation of fluorescent material film 18 becomes active, thus increasing the luminance. At a portion (points h to k) where internal electrode 14 is close to external electrode 20 and electrode 20 is made wider ($W_2$), the quantity of electrons emitted would increase by the increased amount of the width. Consequently, the current density at points h to k increases. Therefore, although the distance between internal electrode 14 and external electrode 20 at these points is not sufficiently large to accelerate the electrons, the excitation of fluorescent material film 18 becomes more active by the increased amount of electrons. This would result in an increase in the luminance at points h to k. Consequently, as should be clear from FIG. 6, lamp 10 that uses the external electrode having a wider width at a predetermined portion has a nearly uniform luminance distribution along the axis of tube 12 as compared with the lamp that uses the standard external electrode having an even width. Furthermore, as slit 24 is provided outside of tube 12, the irradiated light has a directivity and can be shaped into a considerably thin beam.

As has been explained above, since in the gas discharge lamp having its external electrode provided on the outer surface of the tube, the external electrode is made wider at a predetermined portion, the quantity of electrons emitted from the internal electrode to the external electrode increases and the current density there becomes higher accordingly, thus increasing the luminance. That means that by changing the width of the external electrode at a desired portion, the luminance can be changed at the desired portion accordingly. That is, a gas discharge lamp with the desired luminance distribution can be provided by properly varying the width of the external electrode where needed.

The gas discharge lamp is not limited to have one internal electrode as is the case in the first embodiment; two internal electrodes may be attached, one to each end portion of the tube, in a sealed fashion. Further, the external electrode may be formed in a plate shape rather than a film shape.

A gas discharge lamp apparatus according to the second embodiment will be explained below referring to FIGS. 7 and 8.

Discharge lamp 10' includes tube 12 having fluorescent material film 18 formed evenly on the inner surface thereof. As the second embodiment is the same as the aforementioned first embodiment with respect to the constituents of the rare gas sealed within tube 12, gas pressure, internal electrode 14 provided within the tube at one end thereof and lead-in wire 16, the explanation of these parts will be omitted.

External electrode 20 is formed on the whole outer surface of tube 12 from end to end along the axis of the tube 12. The width of external electrode 20, which is set wider only at a predetermined portion along the axis of tube 12, is determined by the luminance distribution. Further, an external receiving end film 28' made of an electroconductive paste such as silver-epoxy resin is formed on the outer surface of the tube to be coupled to external electrode 20.

External electrode 20 and internal electrode 14 are connected to high frequency power source 32 directly and through current-limiting capacitor 30, respectively. High frequency power source 32 is the same as that of the aforementioned embodiment so that its detailed drawing and explanation will be omitted.

In gas discharge lamp 10', high frequency power is supplied from high frequency power source 32 to internal electrode 14 and external electrode 20. This power application produces a glow discharge corresponding to a lamp current of below 20 mA across internal electrode 14 and external electrode 20 within tube 12. The glow discharge excites the rare gas within tube 12. The gas gives forth resonance radiation. This radiation excites fluorescent material film 18, whereby visible light is emitted from film 18 and then from tube 12. The visible light is emitted to the outside of tube 12. In this case, since the gas discharge lamp is not provided with a shielding film, the visible light is emitted from nearly the entire outer surface of tube 12.

The aforementioned gas discharge lamps according to the first and second embodiments are of such a type that use only a rare gas. These rare gas discharge lamps utilize the negative glow section of the glow discharge, offering such an advantage that the light output is not temperature-dependent.

The aforementioned gas discharge lamps need not be restricted to a type utilizing glow discharge and may utilize an arc discharge in which case the internal electrode is partially thickened to accommodate a hot cathode therein to ensure the arc discharge.

The material to be sealed within the tube is not restricted only to rare gas; this invention can equally be used as a low mercury vapor pressure discharge lamp. In a practical lamp using mercury sealed therein, for example, a minute amount of mercury, about 0.1 mg, may be sealed with argon at a pressure of 3 Torrs within the same tube as the rare gas discharge lamp.

The fluorescent material film is not necessarily required as is the case in the third embodiment which will now be explained referring to FIGS. 9 and 10. In discharge lamp 10', a rare gas that emits visible rays is sealed in tube 12. Internal electrode 14 and lead-in line 16 are provided in tube 12 on one end side thereof. External electrode 20 is formed on the outer surface of tube 12 from end to end along the axis of tube 12. External receiving end film 28', made of an electroconductive paste such as silver-epoxy resin, is also provided on the outer surface of tube 12 so as to be connected to external electrode 20. As the structures of internal electrode 14, lead-in line 16, external electrode 20 and external receiving end film 28' are the same as those of the first embodiment and/or the second embodiment, their explanation will be omitted here.

Internal electrode 14 is connected to high frequency power source 32 through current-limiting capacitor 30, and external electrode 20 is connected to the same power source directly. As this high frequency power source 32 is the same as the one used in the first and second embodiments, its detailed drawing and explanation will be omitted.

In the thus constituted gas discharge lamp 10", internal electrode 14 and external electrode 20 are applied with high frequency power from power source 32. Consequently, a glow discharge occurs within gas discharge lamp 10". This discharge produces pink visible rays when the rare gas is argon, orange visible rays for neon gas or claret visible rays for helium gas. If visible rays are generated within tube 12 and used as irradiation light as in the above case, no fluorescent material film is needed. With regard to a low mercury vapor pressure discharge lamp, it can be used as an ultraviolet ray lamp to provide visible rays.

What is claimed is:

1. A gas discharge lamp comprising:

a tube having a discharge gas therein;

an internal electrode provided within said tube; and an external electrode provided on an outer surface of said tube generally parallel to an axis of said tube, said external electrode having a width that is non-uniform along said axis, the width at various positions along said axis being selected so as to obtain a desired luminance distribution, said internal and external electrodes being adapted to be coupled to a high frequency power source to cause discharge within said tube.

2. A gas discharge lamp according to claim 1, wherein the width of said external electrode is selected so as to obtain substantially uniform luminance distribution along said axis.

3. A gas discharge lamp according to claim 2, wherein said external electrode positioned at a center-portion of said tube is formed narrower than that positioned near the ends of said tube.

4. A gas discharge lamp according to claim 1, wherein said discharge gas is at least one of xenon, krypton, argon, neon and helium.

5. A gas discharge lamp according to claim 4, wherein said discharge gas is xenon having its vapor pressure of 30 to 160 Torr.

6. A gas discharge lamp according to claim 4, wherein said discharge gas further includes mercury.

7. A gas discharge lamp according to claim 1, wherein said tube has inner and outer diameters of below 2 mm and below 3 mm, respectively.

8. A gas discharge lamp according to claim 1, which further comprises a fluorescent material layer formed on an inner surface of said tube.

9. A gas discharge lamp according to claim 1, which further comprises light shielding means formed on said tube for partly shielding light emitted by the discharge.

10. A gas discharge lamp apparatus comprising:

a gas discharge lamp device including a tube having a discharge gas therein, an internal electrode provided within said tube, and an external electrode provided on an outer surface of said tube generally parallel to an axis of said tube, said external electrode having a width that is non-uniform along said axis, the width at various positions along said axis being selected so as to obtain a desired luminance distribution; and a high frequency power source for applying high frequency power to said internal and external electrodes of said gas discharge lamp device to cause discharge within said tube and irradiating visible rays generated by said discharge to the outside of said tube.

* * * * *